US006457669B1

(12) United States Patent
Chuang

(10) Patent No.: US 6,457,669 B1
(45) Date of Patent: Oct. 1, 2002

(54) TUBE WINDER STRUCTURE

(75) Inventor: Po-Chao Chuang, Taichung (TW)

(73) Assignee: Chin How Taiwan Inc., Taichung (TW)

( * ) Notice: Subject to any disclaimer, the term of this patent is extended or adjusted under 35 U.S.C. 154(b) by 0 days.

(21) Appl. No.: 09/765,414

(22) Filed: Jan. 22, 2001

(51) Int. Cl.[7] ..... B65H 57/14; B65H 57/04; B65H 57/02; B65H 85/14; B65H 85/04

(52) U.S. Cl. ..... 242/588.2; 242/397; 242/397.1; 242/597.8

(58) Field of Search ..... 242/397, 397.1, 242/588, 588.2, 597, 597.8, 615, 615.3

(56) References Cited

U.S. PATENT DOCUMENTS

| | | | | | |
|---|---|---|---|---|---|
| 664,640 | A | * | 12/1900 | Huebner | 242/615.3 |
| 975,245 | A | * | 11/1910 | Hughes | 242/397 |
| 2,685,419 | A | * | 8/1954 | Helberg | 242/597.8 |
| 2,738,143 | A | * | 3/1956 | Hannay | 242/397.1 |
| 3,944,161 | A | * | 3/1976 | Kauf | 242/96 |
| 4,228,553 | A | * | 10/1980 | Genuit | 4/490 |
| 4,251,038 | A | * | 2/1981 | Gename | 242/86 |
| 4,306,688 | A | * | 12/1981 | Hechler, IV | 242/86 |
| 4,756,486 | A | * | 7/1988 | Campbell | 242/84.1 |
| 4,979,693 | A | * | 12/1990 | Eberhardt et al. | 242/96 |
| 5,179,972 | A | * | 1/1993 | Eley | 137/355.19 |
| 5,381,820 | A | * | 1/1995 | Chandler | 137/355.23 |
| 5,421,533 | A | * | 6/1995 | Scott et al. | 242/405.3 |
| 5,462,298 | A | * | 10/1995 | Bodine | 280/47.34 |
| 5,566,901 | A | * | 10/1996 | Wilder | 242/532.6 |
| 5,655,728 | A | * | 8/1997 | Yang | 242/395.1 |
| 5,934,314 | A | * | 8/1999 | Spear et al. | 137/355.16 |
| 5,938,140 | A | * | 8/1999 | Fundak | 242/396.2 |
| 6,199,786 | B1 | * | 3/2001 | Lessard et al. | 242/406 |
| 6,206,317 | B1 | * | 3/2001 | Harvestine | 242/395 |
| 2002/0074447 | A1 | * | 6/2002 | Schneider | 242/566 |

FOREIGN PATENT DOCUMENTS

| | | | | |
|---|---|---|---|---|
| JP | 8-66486 | * | 8/1994 | 242/397 |

* cited by examiner

*Primary Examiner*—Donald P. Walsh
*Assistant Examiner*—Daniel K Schlak
(74) *Attorney, Agent, or Firm*—Rosenberg, Klein & Lee

(57) ABSTRACT

A tube winder structure including a seat body and a reel. The seat body has a stand, a handle and a shaft. The reel is rotatably fitted on the shaft of the seat body. The handle of the seat body has a tube-squeezing unit composed of the handle and a rod member parallel to the handle. A gap-adjusting mechanism is connected between the handle and the rod member for adjusting the gap between the handle and the rod member. During winding of the tube, the tube-squeezing unit is able to drain the water from the flat tube and simultaneously flatten the flat tube so as to reduce the volume thereof, whereby the flattened flat tube can be smoothly wound and collected on the reel.

2 Claims, 4 Drawing Sheets

TUBE WINDER STRUCTURE

BACKGROUND OF THE INVENTION

The present invention is related to a tube winder structure including a tube-squeezing unit which is adjustable in gap, whereby during winding of the tube, the water is drained out from the flat tube and the flat tube is simultaneously flattened so as to reduce the volume of the flat tube. Therefore, the flattened flat tube can be smoothly wound and collected.

FIG. 6 shows a conventional tube winder composed of a seat body 7 and a reel 8. The seat body 7 has a shaft 71 and the reel 8 has a cylindrical barrel section 81. Two sides of the barrel section 81 are respectively formed with two stop flanges 82, 83. A crank ( not shown) is disposed on outer side of one stop flange 82. The reel 8 is rotatably fitted on the shaft 71 of the seat body 7. When winding a tube, by means of cranking the crank, the reel 8 is rotated to wind and collect a flat tube 9 around the barrel section 81 of the reel 8.

During the winding of the flat tube 9, it is impossible for the conventional tube winder to drain the water remaining in the flat tube 9. As a result, after the flat tube 9 is completely wound, a large amount of water will still remain in the flat tube 9. Therefore, the tube winder with the flat tube 9 will have a very heavy weight. Moreover, the water remaining in the tube tends to culture moss on the inner wall face of the flat tube 9. Consequently, in next use of the flat tube 9, contaminated water will flow out of the flat tube 9. Therefore, it is necessary to frequently clean up the inner wall face of the flat tube 9. In addition, during winding of the flat tube 9, the conventional tube winder fails to flatten the tube 9 so as to reduce the volume thereof. Therefore, length of the tube 9 wound around the same size of reel 8 will be shortened. As a result, the conventional tube winder cannot be more flexibly used and the application range of the conventional tube winder is limited.

SUMMARY OF THE INVENTION

It is therefore a primary object of the present invention to provide a tube winder structure including a tube-squeezing unit composed of a handle and rod member parallel to the handle. The gap between the handle and the rod member can be adjusted. During winding of a flat tube, a connector of the flat tube is first stopped by stop plates on inner side of a window of the reel of the tube winder. The tube body of the flat tube is then wound into the tube-squeezing unit from one side. By means of cranking a crank of the reel, the reel is rotated to wind the flat tube thereon. When the flat tube passes through the tube-squeezing unit, the gap is such defined between a sleeve fitted on the rod member and the handle as to squeeze and flatten the flat tube. At the same time, the flattened flat tube is wound to planely attach to the wall face of the barrel section of the reel. Also, the water is synchronously drained out of the tube. Accordingly, after the flat tube is completely wound and collected, no water will remain in the flat tube so that the tube winder with the flat tube will have light weight. In addition, it is not easy to culture moss on the inner wall face of the flat tube. Consequently, it is unnecessary to clean up the inner wall face in next use of the flat tube.

It is a further object of the present invention to provide the above above tube winder structure in which, during winding of the tube, the tube-squeezing unit is able to simultaneously flatten the flat tube and reduce the volume thereof. Therefore, the flattened flat tube can be smoothly wound to planely attach to the wall face of the barrel section of the reel. As a result, the same size of reel can collect a maximum length of flat tube so that the reel can be more widely used in various tube-winding situations. Therefore, the tube winder can be more flexibly and conveniently used.

The present invention can be best understood through the following description and accompanying drawings wherein:

DETAILED DESCRIPTION OF THE PREFERRED EMBODIMENT

Figure 1:
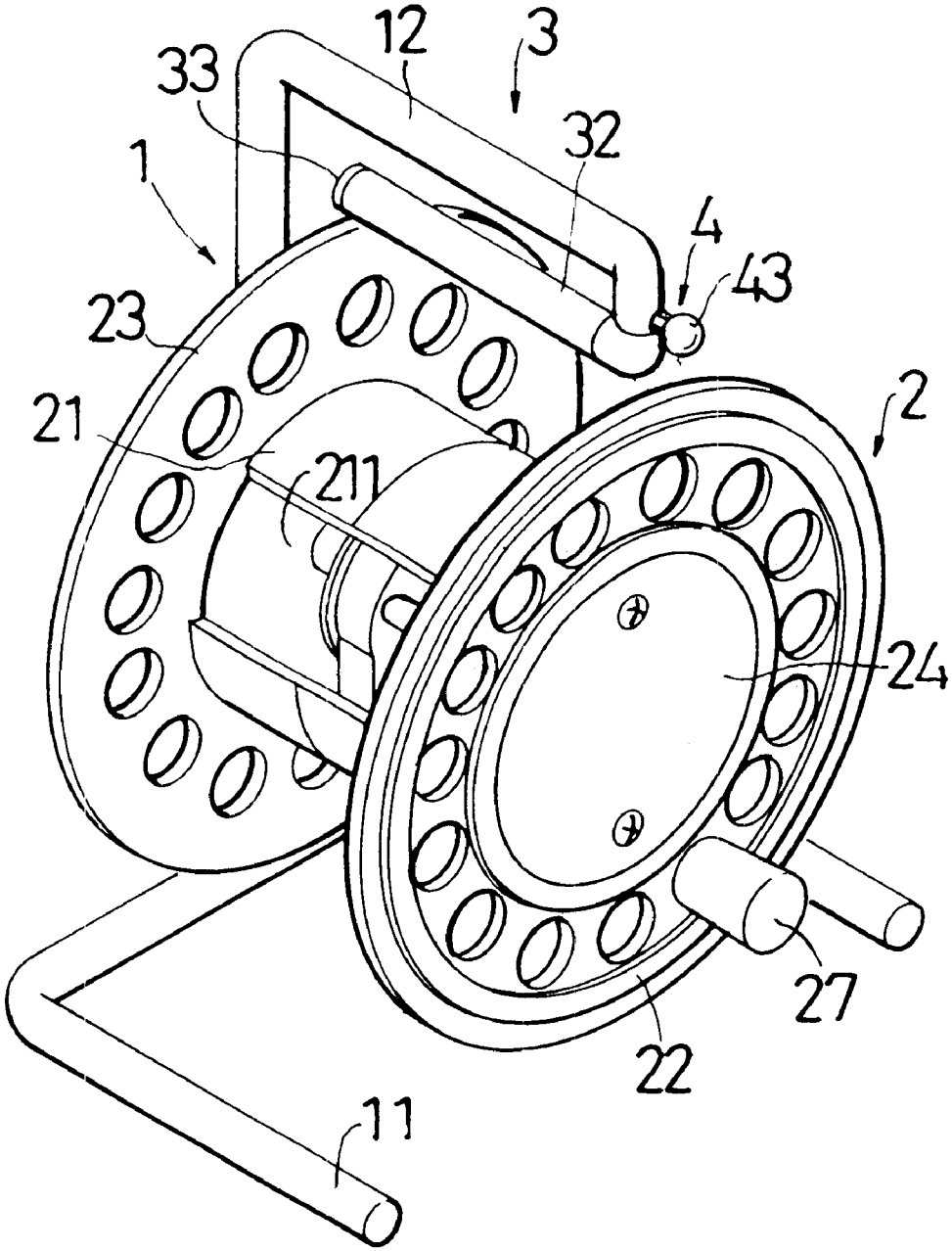
FIG. 1 is a perspective assembled view of the present invention.
Figure 2:
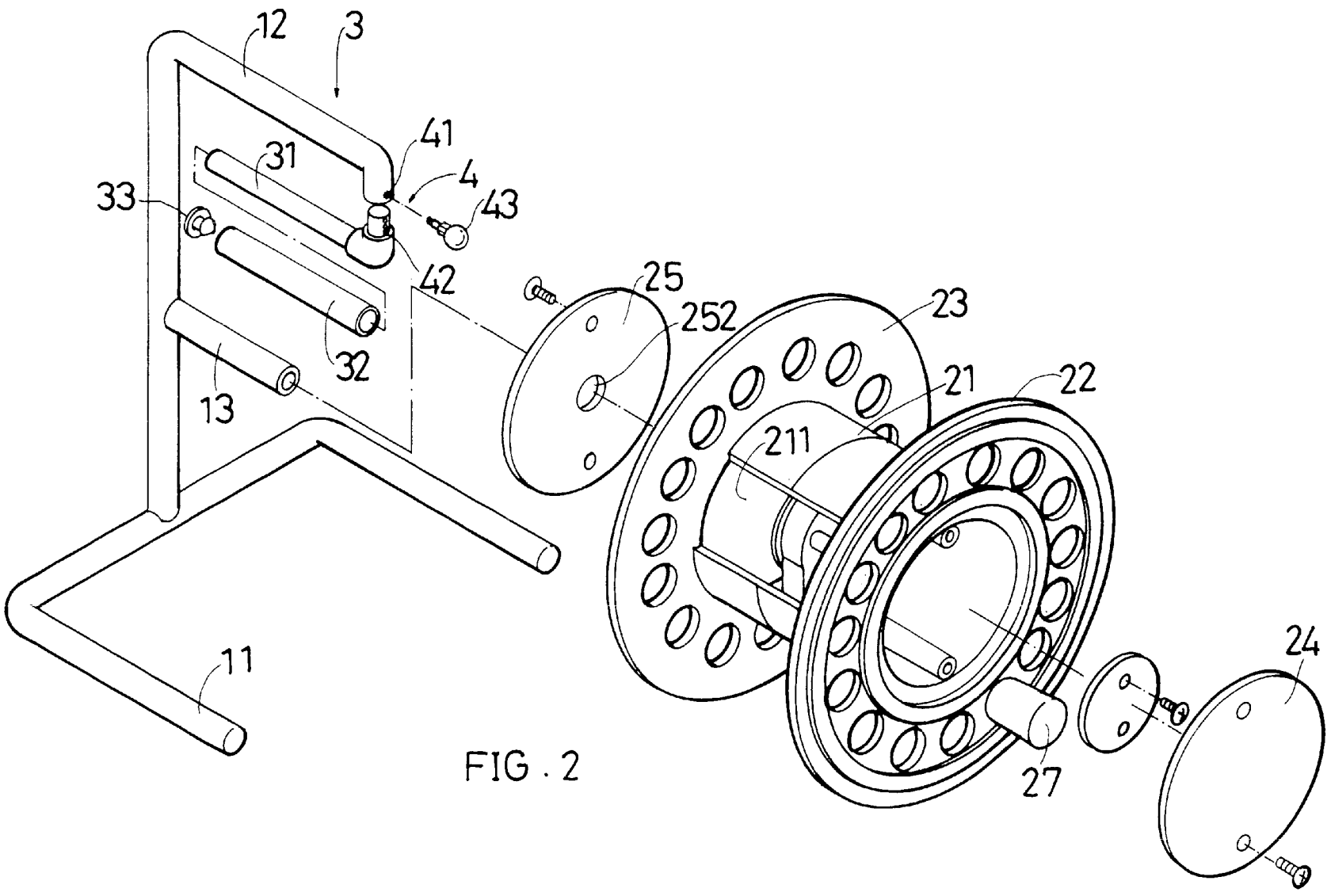
FIG. 2 is a perspective exploded view of the present invention.
Figure 3:
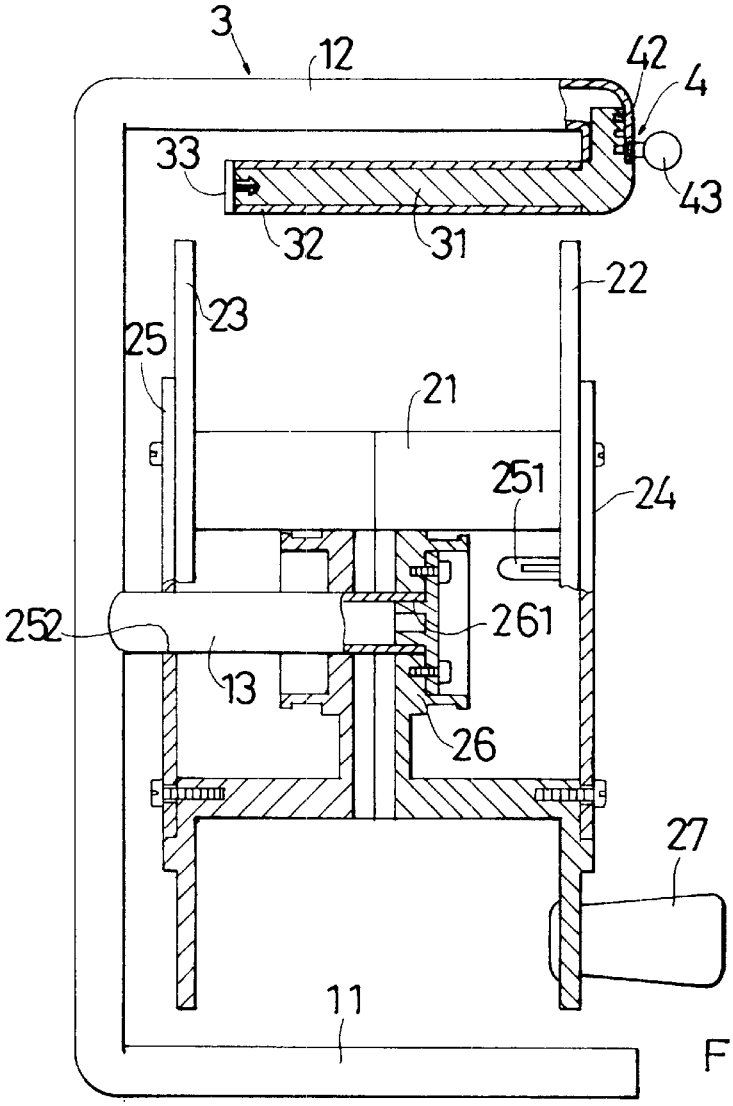
FIG. 3 is a sectional assembled view of the present invention.
Figure 4:
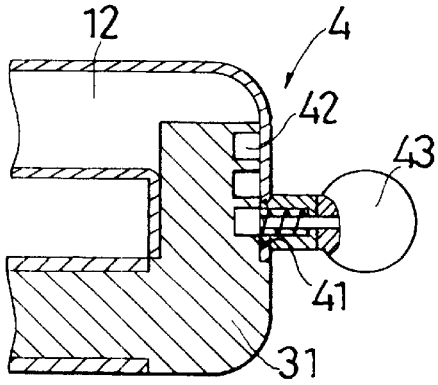
FIG. 4 is a sectional view showing the gap-adjusting mechanism of the present invention.

Please refer to FIGS. 1 to 5. The tube winder of the present invention includes a seat body 1 and a reel 2.

The seat body 1 has a stand 11, a handle 12 and a shaft 13. The shaft 13 is connected with the stand 11 and the handle 12. The handle 12 has a tube-squeezing unit 3 composed of the handle 12 and a solid rod member 31 parallel to the handle 12. A sleeve 32 is fitted around the rod member 31. One end of the rod member 31 via a gap-adjusting mechanism 4 is connected with the handle 12. A cap is fitted with the other end of the rod member 31 for preventing the sleeve 32 from slipping out from the rod member 31. The gap-adjusting mechanism 4 is formed by several orifices 41 of the handle 12, several sockets 42 of the rod member 31 and a spring insertion pin 43. The spring insertion pin 43 is adjustably inserted in any of the orifices 41 and any of the sockets 42 so as to adjust the gap between the handle 12 and the rod member 31.

The reel 2 has a hollow cylindrical barrel section 21, a crank 27 and a support seat 26. Two lateral sides of the barrel section 21 are respectively formed with a first side wall 24 and a second side wall 25. Two stop flanges 22, 23 respectively outward extend from the first and second side walls 24, 25. The circumferential wall of the barrel section 21 is formed with a rectangular window 211. Two sides of the rectangular window 211 are respectively adjacent to the first and second side walls 24, 25. Several stop plates 241, 251 are respectively formed on the wall faces of the first and second side walls 24, 25 inside the rectangular window 211. The crank 27 is movably disposed on outer side of the stop flange 22 of the first side wall 24. The second side wall 25 is formed with a hole 252. The support seat 26 is radially formed in the barrel section 21. The support seat 26 is formed with a through hole 261 in alignment with the hole 252 of the second side wall 25. The shaft 14 of the seat body 1 is pivotally fitted in the hole 252 and the through hole 261.

Figure 5:
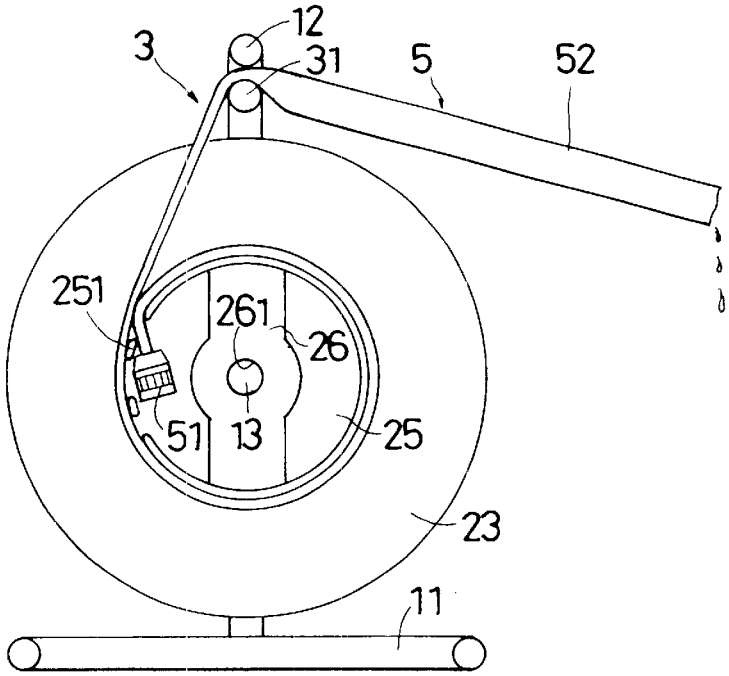
FIG. 5 shows the operation of the present invention.
Figure 6:
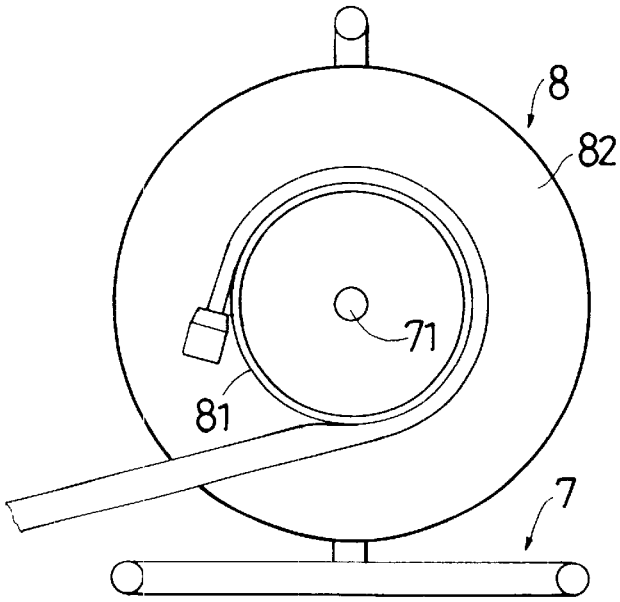
FIG. 6 PRIOR ART
FIG. 6 is a side view of a conventional tube winder.

Referring to FIG. 5, in use of the present invention, a connector 51 of a flat tube 5 is conducted into the rectangular window 211 and stopped by the stop plates 241 on inner side thereof. The tube body 52 of the flat tube 5 is wound into the tube-squeezing unit 3 from one side. By means of cranking the crank 27 of the reel 2, the reel 2 is rotated to wind the flat tube 5 thereon. When the flat tube 5 passes through the tube-squeezing unit 3, the gap is such defined between the sleeve 32 and the handle 12 as to squeeze and flatten the flat tube 5. The outer wall face of the flat tube 5 contacts with the sleeve 32 so that the sleeve 32 is rotated along with the wound flat tube 5. Therefore, the resistance against the winding of the flat tube 5 is reduced. At the same time, the flattened flat tube 5 is wound to planely attach to the wall face of the barrel section 21 of the reel 2. Therefore, the water is drained out of the flat tube 5 and the volume of the flat tube 5 is reduced.

In conclusion, by means of the tube-squeezing unit 3 of the handle 12, the gap between the handle 12 and the rod member 31 can be adjusted to flatten the flat tube 5 during winding of the tube. Also, the water is synchronously drained out of the tube. Accordingly, after the flat tube 5 is completely wound and collected, no water will remain in the flat tube 5 so that the tube winder with the flat tube 5 will have light weight. In addition, it is not easy to culture moss on the inner wall face of the flat tube 5. Consequently, it is unnecessary to clean up the inner wall face in next use of the flat tube 5. In addition, during winding of the tube, the tube-squeezing unit 3 is able to simultaneously flatten the flat tube 5 and reduce the volume thereof. Therefore, the flattened flat tube 5 can be smoothly wound to planely attach to the wall face of the barrel section 21 of the reel 2. As a result, the same size of reel 2 can collect a maximum length of flat tube 5 so that the reel 2 can be more widely used in various tube-winding situations. Therefore, the tube winder can be more flexibly and conveniently used.

The above embodiment is only used to illustrate the present invention, not intended to limit the scope thereof. Many modifications of the above embodiment can be made without departing from the spirit of the present invention.

What is claimed is:

1. A tube winder structure comprising:

a tube;

a seat body having a stand, a handle and a shaft;

a reel rotatably fitted on the shaft of the seat body and having a crank for winding, the tube in a flattened condition onto the reel, the seat body having a tube-squeezing unit, the tube-squeezing unit including (a) the handle, (b) a rod member extending from a first portion of the handle and being disposed in spaced parallel relationship with respect to a second portion of the handle, (c) a sleeve rotatably fitted around the rod member, and (d) a cap coupled to a distal end of the rod member for retaining the sleeve on the rod member, the space between the rod member and the second portion of the handle being loss than a diameter of the tube to thereby flatten the tube as the lube is passed therethrough; and, a gap-adjusting mechanism connected between the first portion of the handle and the rod member, the gap-adjusting mechanism being formed by several orifices formed in the first portion of the handle, several sockets formed in the rod member and an insertion pin, the insertion pin being adjustably inserted in any selected one of the orifices and any selected one of the sockets.

2. A tube winder structure comprising:

a tube;

a seat body having a stand, a handle and a shaft; and, a reel rotatably fitted on the shaft of the seat body and having a crank for winding the tube in a flattened condition onto the reel, the seat body having a tube-squeezing unit, the lube-squeezing unit including (a) the handle, (b) a rod member extending from a first portion of the handle and being disposed in spaced parallel relationship with respect to a second portion of the handle, (c) a sleeve rotatably fitted around the rod member, and (d) a cap coupled to a distal end of the rod member for retaining the sleeve on the rod member, the space between the rod member and (he second portion of the handle being less than at diameter of the tube to thereby flatten the tube as the tube is passed therethrough, the reel having a hollow cylindrical barrel section, two lateral sides of the barrel section being respectively formed with two side walls, a circumferential wall of the barrel section being formed with a window, several stop plates being respectively formed on corresponding wall faces of the side walls inside the window.

* * * * *